US012479559B2

(12) United States Patent
Crawford et al.

(10) Patent No.: US 12,479,559 B2
(45) Date of Patent: Nov. 25, 2025

(54) SHOCK ABSORPTION FOR MOTORS

(71) Applicant: Navico, Inc., Tulsa, OK (US)

(72) Inventors: Christopher D. Crawford, Bixby, OK (US); Guy Allen Coonts, Ripley, OK (US); Jeffery Lyle Osterchill, Tulsa, OK (US)

(73) Assignee: Navico, Inc., Tulsa, OK (US)

( * ) Notice: Subject to any disclaimer, the term of this patent is extended or adjusted under 35 U.S.C. 154(b) by 360 days.

(21) Appl. No.: 18/155,949

(22) Filed: Jan. 18, 2023

(65) Prior Publication Data

US 2024/0239469 A1 Jul. 18, 2024

(51) Int. Cl.

*B63H 21/30* (2006.01)
*B63H 20/06* (2006.01)
*B63H 20/00* (2006.01)

(52) U.S. Cl.

CPC ..... *B63H 21/302* (2013.01); *B63H 20/06* (2013.01); *B63H 20/007* (2013.01)

(58) Field of Classification Search

CPC .... B63H 21/302; B63H 21/30; B63H 21/305; B63H 20/06; B63H 20/007; B63H 2021/307

See application file for complete search history.

(56) References Cited

U.S. PATENT DOCUMENTS 2,901,194 A * 8/1959 Shontz ..... B63H 20/36 248/642
3,191,573 A * 6/1965 Hixon ..... B63H 20/10 440/59
3,263,516 A * 8/1966 Chisholm ..... E04G 21/22 74/105
3,724,790 A * 4/1973 Harris ..... B63H 20/007 440/62
3,948,472 A * 4/1976 Metcalf ..... B63H 20/007 248/642
4,033,530 A * 7/1977 Harris ..... B63H 20/10 248/642
4,555,233 A * 11/1985 Klammer ..... B63H 20/007 440/6
4,708,670 A * 11/1987 Peters ..... B63H 20/007 248/642
6,213,821 B1 * 4/2001 Bernloehr ..... B63H 20/106 440/59

(Continued)

*Primary Examiner* — Nkeisha Smith
(74) *Attorney, Agent, or Firm* — Nelson Mullins Riley & Scarborough LLP

(57) ABSTRACT

A trolling motor assembly having improved shock absorption is provided. The trolling motor assembly includes a trolling motor, a first member, a second member, an actuator that is configured to be activated to cause the trolling motor to move between a first position and a second position, and a compliant member connected to the actuator. When the trolling motor is in a first position, the first member dampens shock loading at the actuator or transfers shock loading to a first shock absorber to dampen shock loading. When the trolling motor is in a second position, the second member dampens shock loading at the actuator or transfers shock loading to at least one of the first shock absorber or a second shock absorber to dampen shock loading. The compliant member dampens shock loading to protect the actuator from shock loading as the trolling motor moves between the first and second position.

17 Claims, 13 Drawing Sheets

(56) References Cited

U.S. PATENT DOCUMENTS

| | | | | |
|---|---|---|---|---|
| 6,524,144 | B2 * | 2/2003 | Pasley | B63H 20/007 440/6 |
| 8,814,129 | B2 * | 8/2014 | Todd | B63H 20/007 248/641 |
| 10,173,762 | B1 * | 1/2019 | Gray | B63H 20/06 |
| 10,953,972 | B2 * | 3/2021 | Schroeder | B63H 20/08 |
| 11,584,495 | B2 * | 2/2023 | Hunziker, II | B63H 20/06 |
| 12,195,157 | B1 * | 1/2025 | Kraus | F16M 1/04 |

* cited by examiner

SHOCK ABSORPTION FOR MOTORS

FIELD OF THE INVENTION

Embodiments of the present invention relate generally to motor stow and deploy systems, and more particularly to motor stow and deploy systems that utilize compliant members to provide shock absorption, such as for when the motor is transitioning between a stowed position and a deployed position.

BACKGROUND OF THE INVENTION

Motor assemblies are regularly installed on watercraft. The motor assemblies are attached to the watercraft such that a portion of the motor assemblies extend into a body of water when the motor assembly is in the deployed position. The motor assemblies are often retractable so that the motor assembly is movable from the deployed position to a stowed position (e.g., out of the body of water).

When the motor assemblies are attached to a watercraft, the motor assemblies are subject to various forces. These forces include variable forces from waves in the body of water and from the gusts of wind. These forces act on the motor assembly and generate shock loading in various components of the motor assembly.

BRIEF SUMMARY OF THE INVENTION

The amount of dampening of shock loading on motor assemblies attached to watercraft is often limited, especially at times when the motor assembly is actively being moved into or out of the body of water (e.g., moving between the deployed position and the stowed position) thus, creating a higher risk of damage and fatigue in the components of the motor assembly. The actuator of the motor assembly (which may be used to cause the movement of the motor assembly between the deployed position and the stowed position) frequently experiences high amounts of shock loading, especially when the actuator is actively being used to cause movement of the motor assembly into or out of the body of water. This shock loading often leads to damage or fatigue in the motor assembly when uncontrolled.

Various embodiments herein aid in dampening shock loading caused at motor assemblies such as a trolling motor assembly. One or more compliant members are added to the motor assembly, and these compliant members may either absorb the shock loading or transfer the shock loading to another shock absorber. Notably, in various embodiments, these compliant member(s) aid in dampening or transferring shock loading at times when the motor assembly is actively being moved into or out of a body of water. In some embodiments, the compliant member(s) may also aid in dampening or transferring the shock loading when the motor assembly is in a stationary position within the body of water or outside of the body of water. With the compliant member(s) provided, the components of the motor assembly may better withstand shock caused by variable forces from waves, wind, etc. Since the compliant member(s) aid in controlling the amount of shock loading in a motor assembly, the amount of shock loading acting on various components of the motor assembly such as an actuator may be reduced, and these components may function properly for longer periods of time.

Various types of compliant member(s) may be used to aid in controlling the amount of shock loading by dampening the shock loading or transferring the shock loading to another shock absorber. For example, the compliant member(s) may be provided as one or more connectors comprising an elastic material, the compliant member(s) may be provided as one or more grommets, the compliant member(s) may be provided as one or more spring assemblies positioned at various locations on the motor assembly, and/or the compliant member(s) may be provided as one or more modified connection rods having one or more spring assemblies therein. Other compliant members may also be utilized.

In an example embodiment, a trolling motor assembly having improved shock absorption is provided. The trolling motor assembly includes a trolling motor. The trolling motor assembly also includes an actuator that is configured to be activated to cause the trolling motor to move between a first position and a second position. The trolling motor assembly also includes a first member, a second member, and a compliant member that is configured to connect to the actuator. When the trolling motor is in a first position, the first member is configured to dampen shock loading at the actuator or to transfer shock loading to a first shock absorber to dampen shock loading at the actuator. When the trolling motor is in a second position, the second member is configured to dampen shock loading at the actuator or to transfer shock loading to at least one of the first shock absorber or a second shock absorber to dampen shock loading at the actuator. The compliant member is configured to dampen shock loading to protect the actuator from shock loading as the trolling motor moves between the first position and the second position.

In some embodiments, the first member may be configured so that the first member dampens shock loading at the actuator or transfers shock loading in increased amounts when the trolling motor is in the first position as compared to other instances when the trolling motor is in the second position or at an intermediary position between the first position and the second position. Additionally, the second member may be configured so that the second member dampens shock loading at the actuator or transfers shock loading in increased amounts when the trolling motor is in the second position as compared to other instances when the trolling motor is in the first position or at an intermediate position between the first position and the second position.

In some embodiments, the first member may be configured so that, when the trolling motor is in the second position or moving between the first position and the second position, the first member neither dampens shock loading at the actuator nor transfers shock loading. Additionally, in some embodiments, the second member may be configured so that, when the trolling motor is in the first position or moving between the first position and the second position, the second member neither dampens shock loading at the actuator nor transfers shock loading.

In some embodiments, the trolling motor assembly may also include a support structure. Activation of the actuator may cause movement of the support structure so that the trolling motor moves between the first position and the second position. Additionally, in some embodiments, the trolling motor assembly may also include a mount, and the support structure may include a hub. The mount may include a hub cavity that is configured to receive the hub, and the support structure may be configured to rotate relative to the mount about the hub. Furthermore, in some embodiments, the support structure may include the first member, and the mount may define a first recess. The first member may be configured to be received in the first recess when the trolling motor is in the first position, and contact between the first member and a wall forming the first recess may dampen shock loading at the actuator or transfers shock loading to the first shock absorber. In some embodiments, the support structure may include the second member, and the mount may define a second recess. The second member may be configured to be received in the second recess when the trolling motor is in the second position, and contact between the second member and a wall forming the second recess may dampen shock loading at the actuator or transfers shock loading to the first shock absorber or the second shock absorber.

In some embodiments, the trolling motor assembly may be configured such that the trolling motor is positioned out of the water when in the first position, and the trolling motor assembly may be configured such that the trolling motor is positioned in the water when in the second position. In some embodiments, the compliant member may be configured to be compressed or expanded under loads without any deformation in the compliant member when the loads are removed.

In some embodiments, the compliant member may be a grommet. Additionally, in some embodiments, the compliant member may include an elastomeric material. In some embodiments, the compliant member may include a spring assembly. Furthermore, in some embodiments, the spring assembly may include a rotational spring or a linear spring.

In some embodiments, the complaint member may include at least one of hard rubber or steel. In some embodiments, the complaint member may include at least one of an elastomer, a gas shock, a gas damper, a hydraulic shock, or a hydraulic damper.

In some embodiments, the complaint member may provide additional strength to the trolling motor assembly in rough water. In some embodiments, the compliant member may reduce a likelihood of failure of components in the actuator.

In another example embodiment, a motor assembly having improved shock absorption is provided. The motor assembly includes a motor. The motor assembly also includes an actuator that is configured to be activated to cause the motor to move between a first position to a second position. The motor assembly also includes a first member, a second member, and a compliant member that is configured to connect to the actuator. When the motor is in a first position, the first member is configured to dampen shock loading at the actuator or to transfer shock loading to a first shock absorber to dampen shock loading at the actuator. When the motor is in a second position, the second member is configured to dampen shock loading at the actuator or to transfer shock loading to at least one of the first shock absorber or a second shock absorber to dampen shock loading at the actuator. The compliant member is configured to dampen shock loading to protect the actuator from shock loading as the motor moves between the first position and the second position.

In another example embodiment, a method of making a trolling motor assembly having improved shock absorption is provided. The method includes providing a trolling motor, providing an actuator, providing a first member and a second member, providing a compliant member, and connecting the compliant member to the actuator. The actuator is configured to be activated to cause the trolling motor to move between a first position to a second position. The trolling motor is positioned out of water when in the first position. When the trolling motor is in the first position, the first member is configured to dampen shock loading at the actuator or to transfer shock loading to a first shock absorber to dampen shock loading at the actuator. The trolling motor is positioned in the water when in the second position. When the trolling motor is in the second position, the second member is configured to dampen shock loading at the actuator or to transfer shock loading to at least one of the first shock absorber or a second shock absorber to dampen shock loading at the actuator. The compliant member is configured to dampen shock loading to protect the actuator from shock loading as the trolling motor moves between the first position and the second position.

BRIEF DESCRIPTION OF THE DRAWINGS

Figure 1:
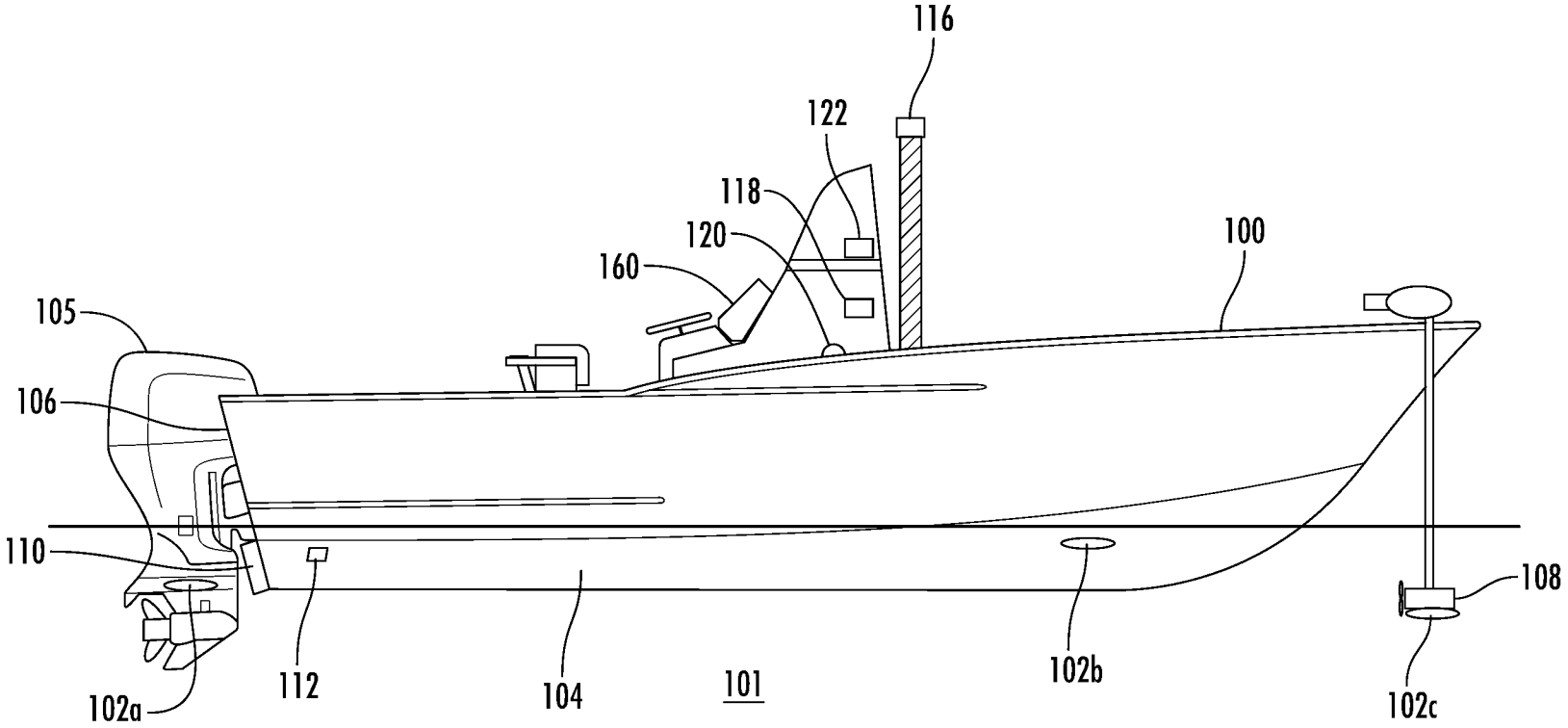
Figure 2A:
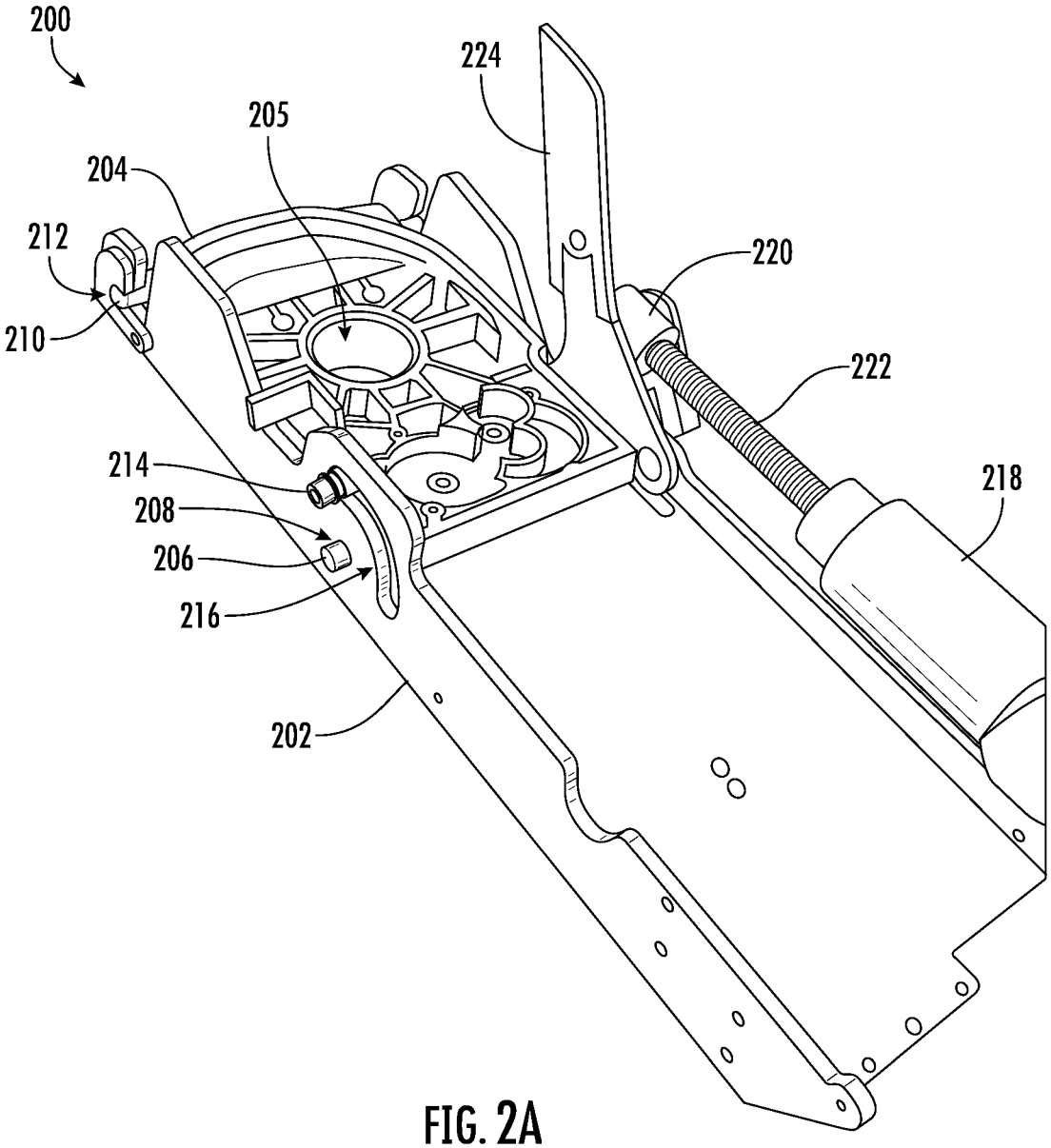
Figure 2B:
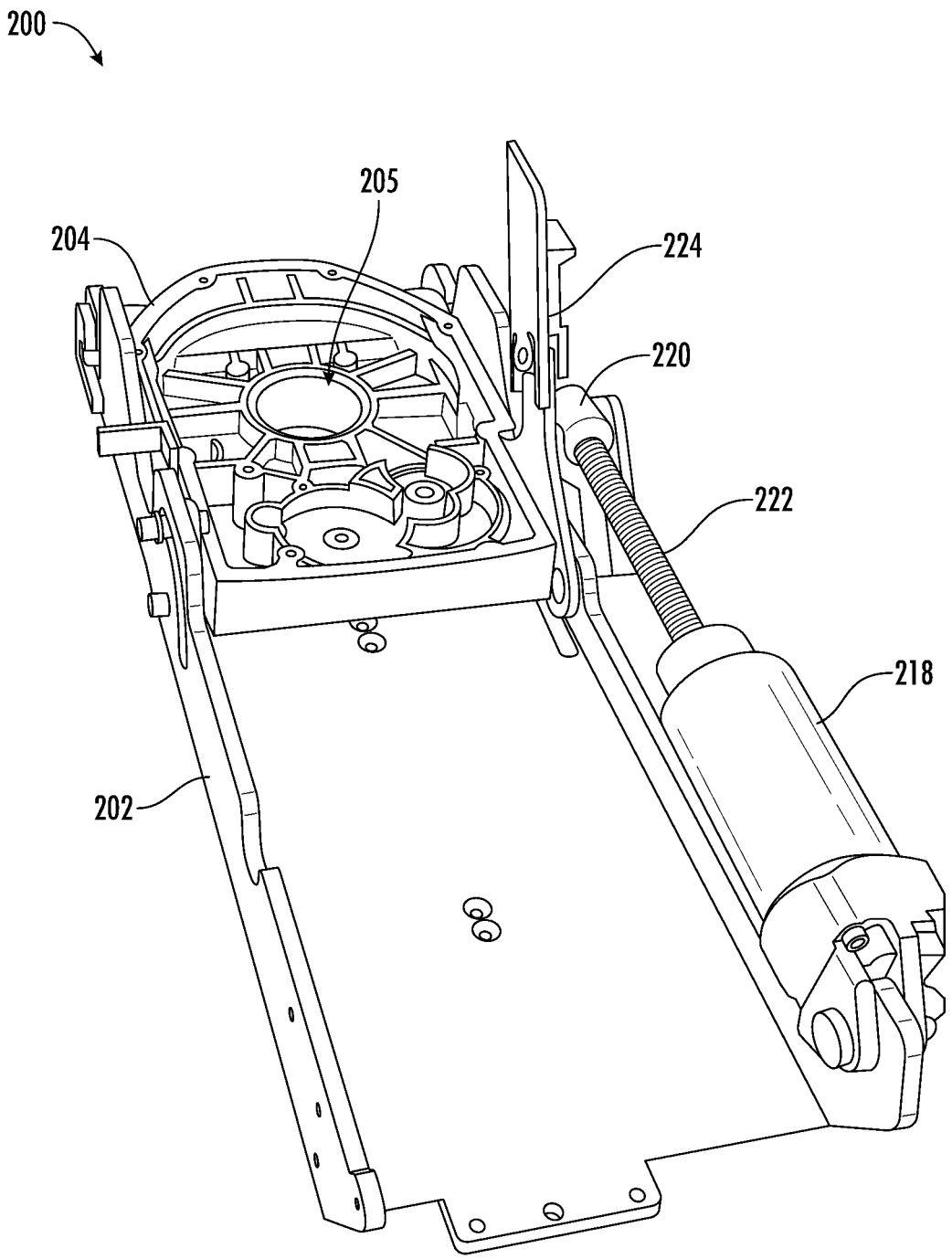
Figure 2C:
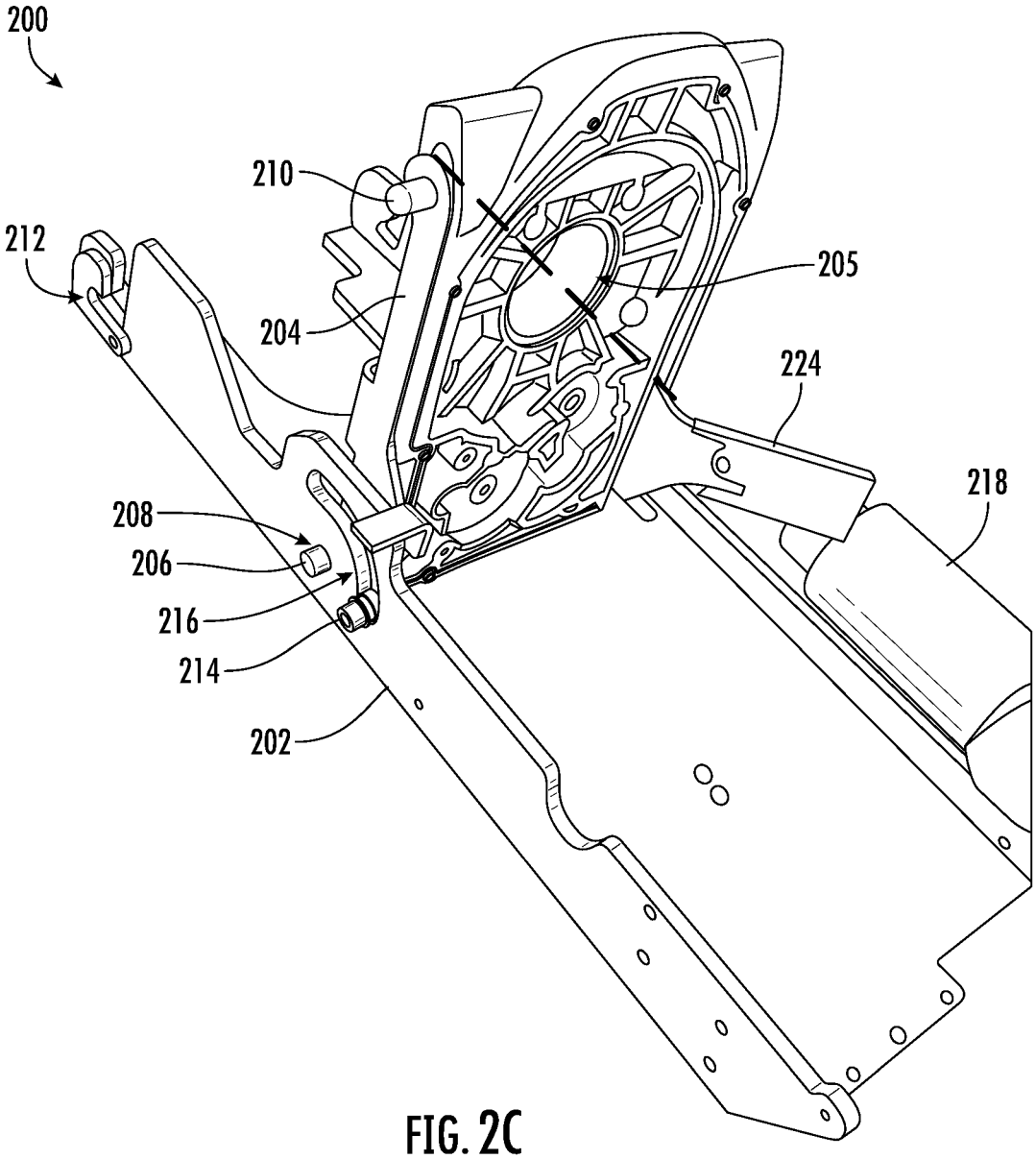
Figure 3A:
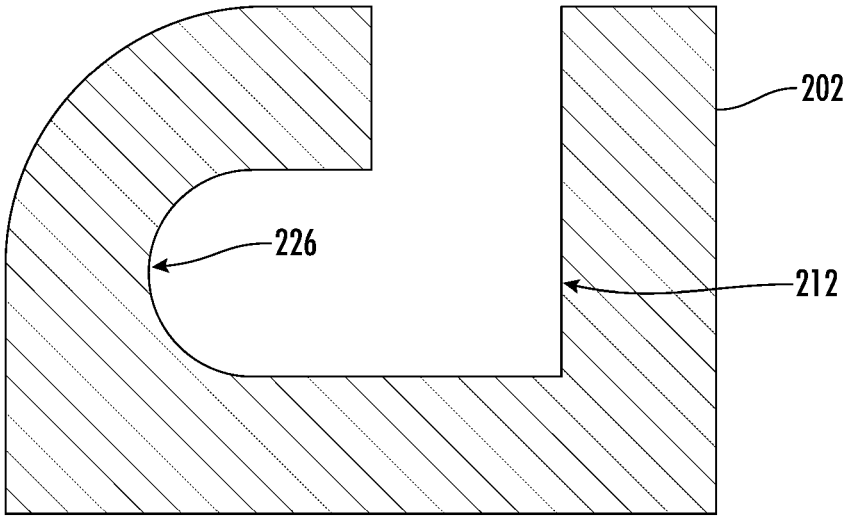
Figure 3B:
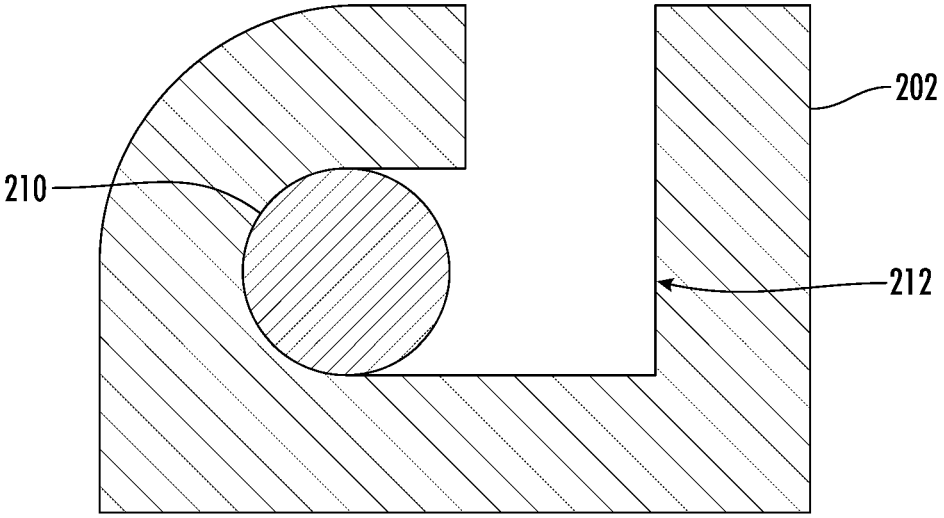
Figure 4A:
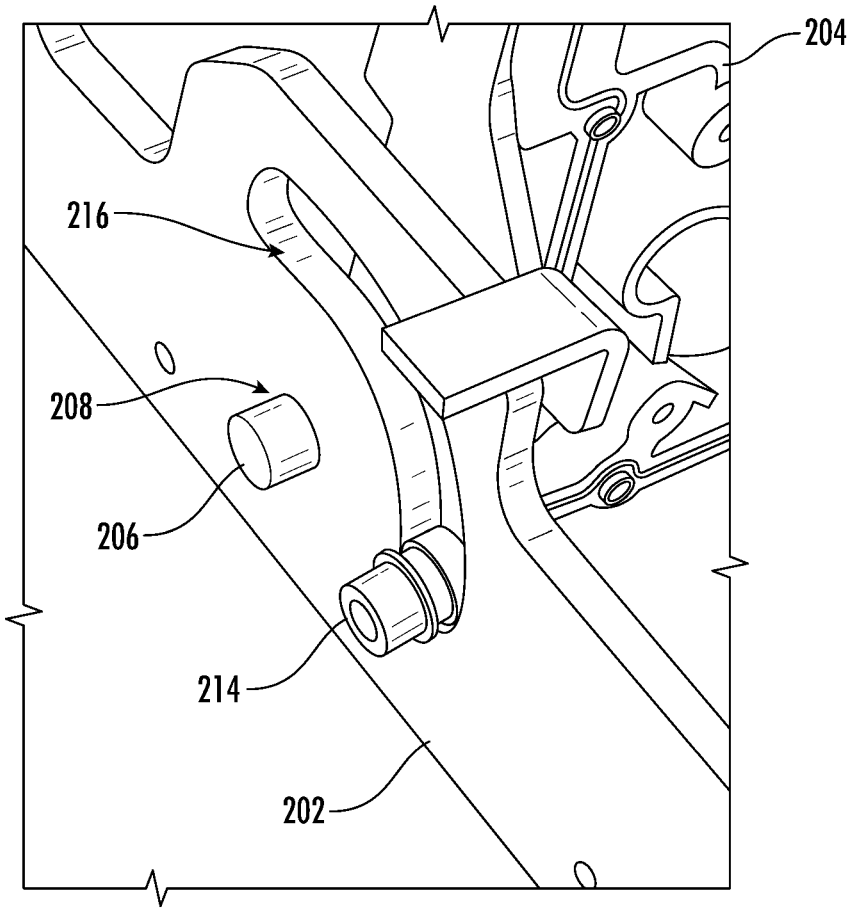
Figure 4B:
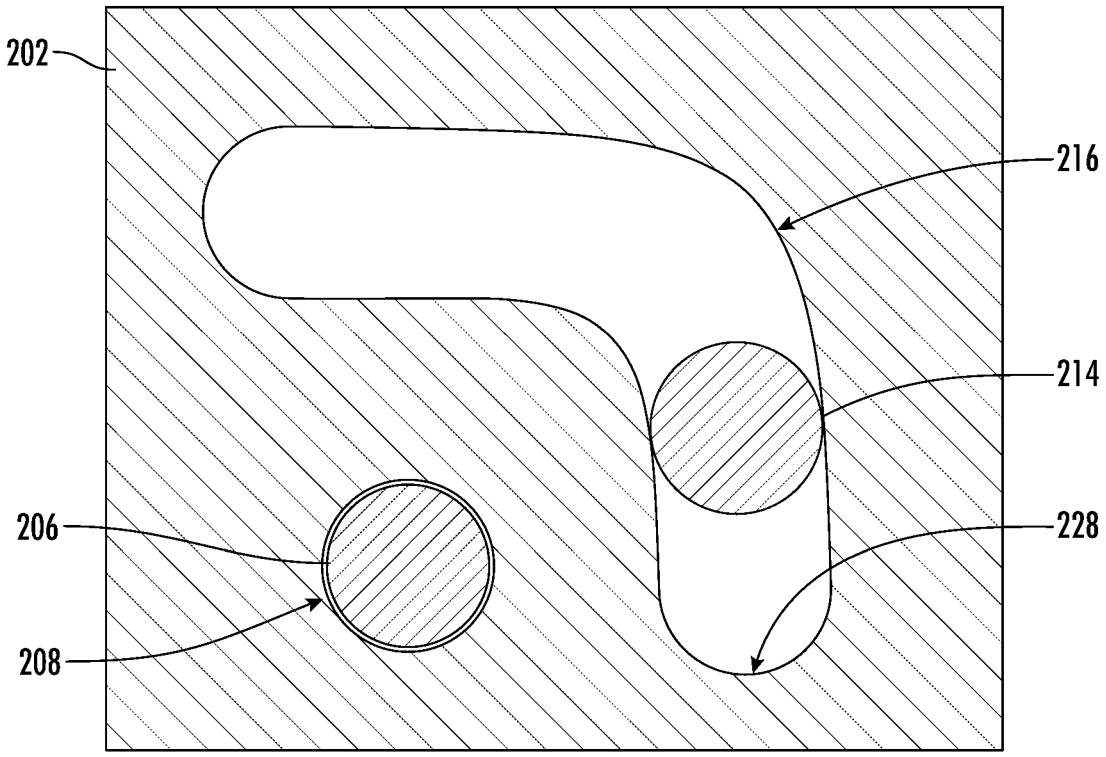
Figure 5:
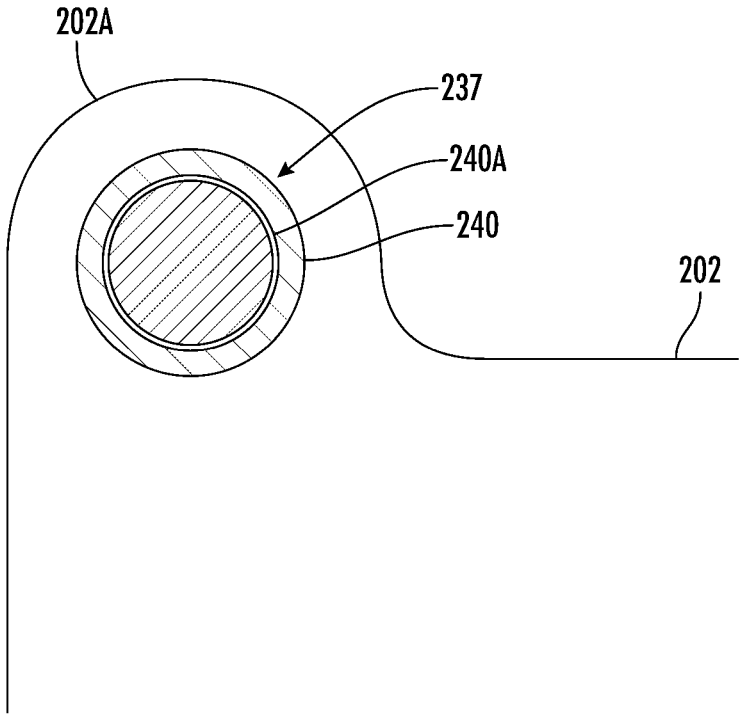
Figure 6:
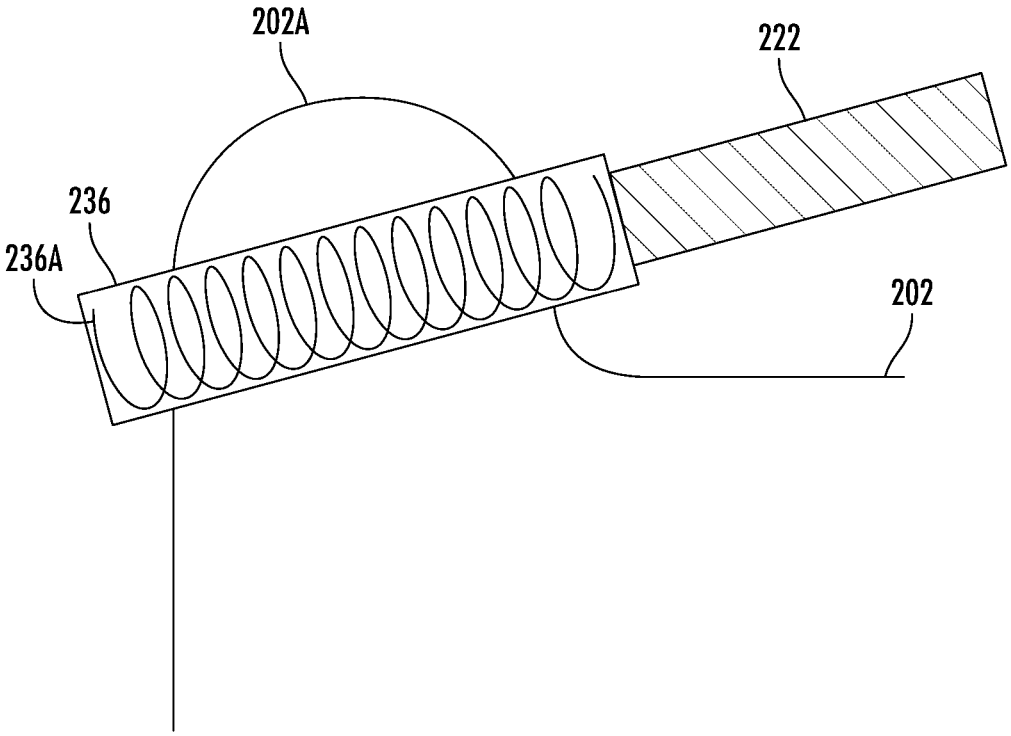
Figure 7:
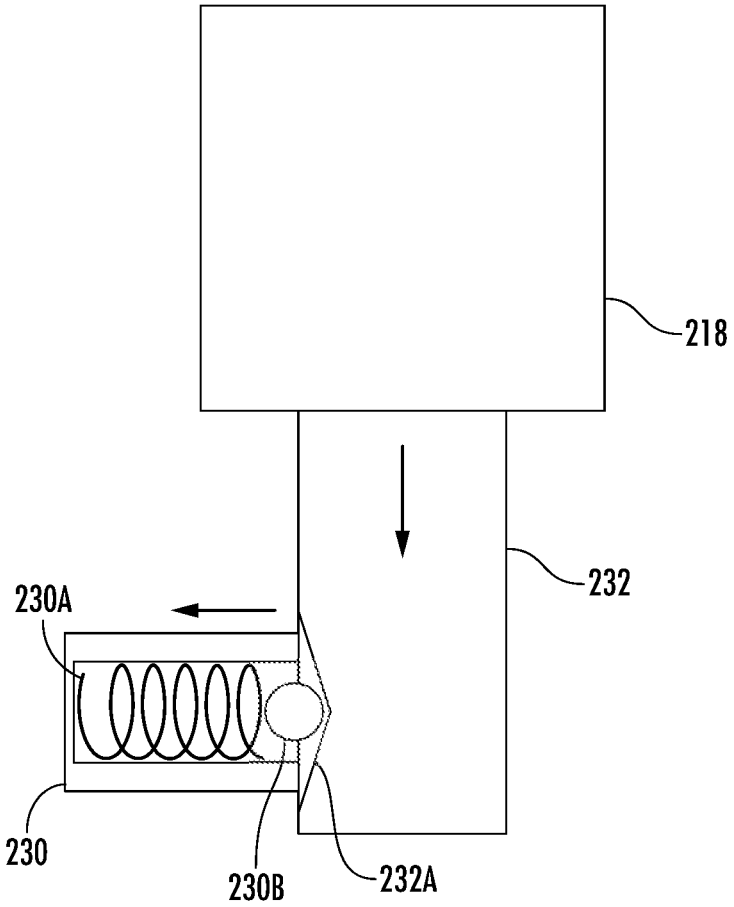
Figure 8A:
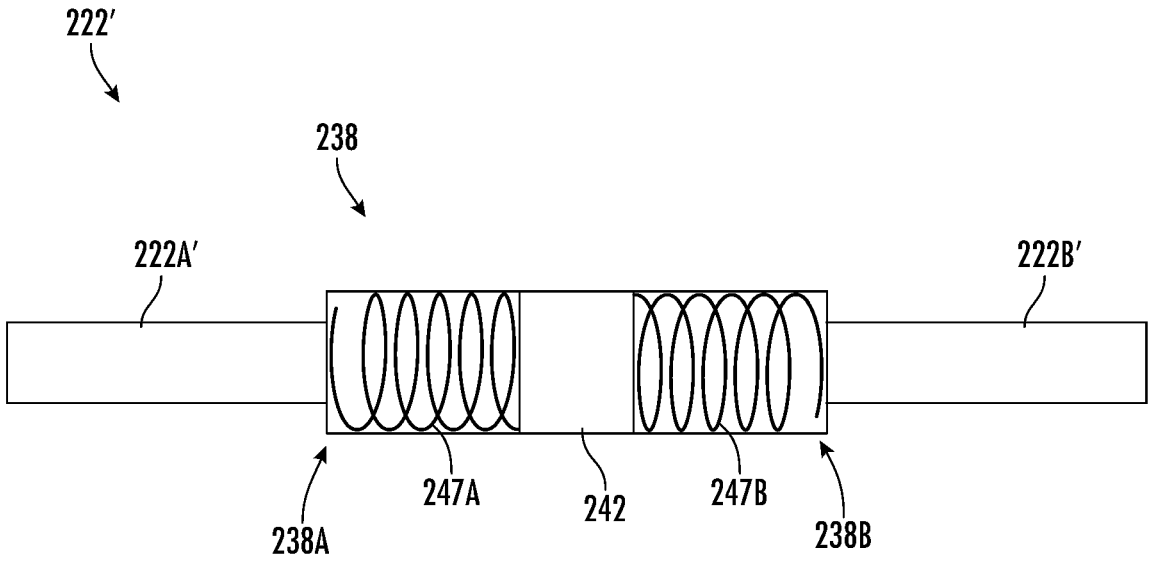
Figure 8B:
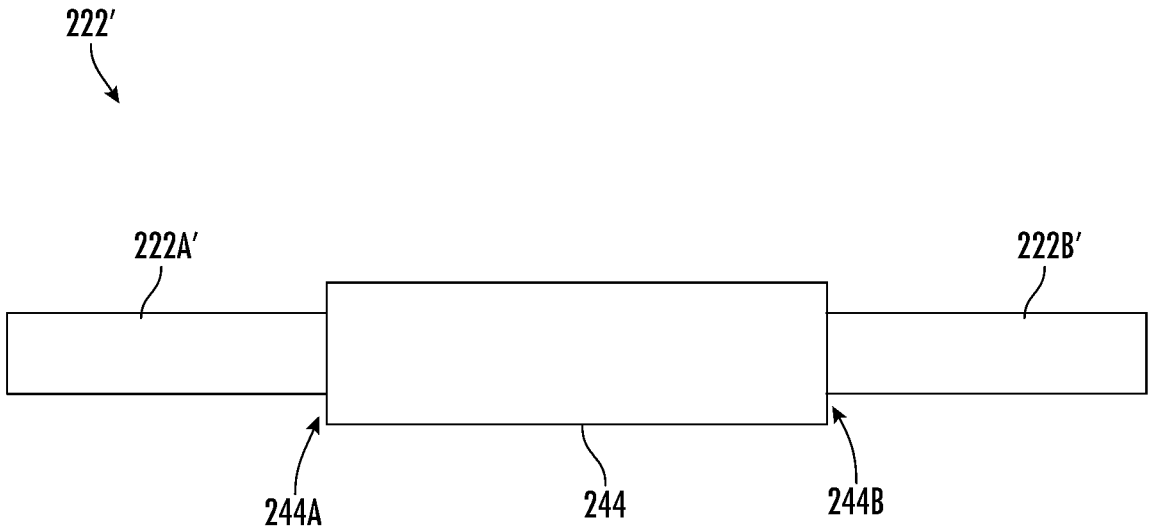
Figure 9:
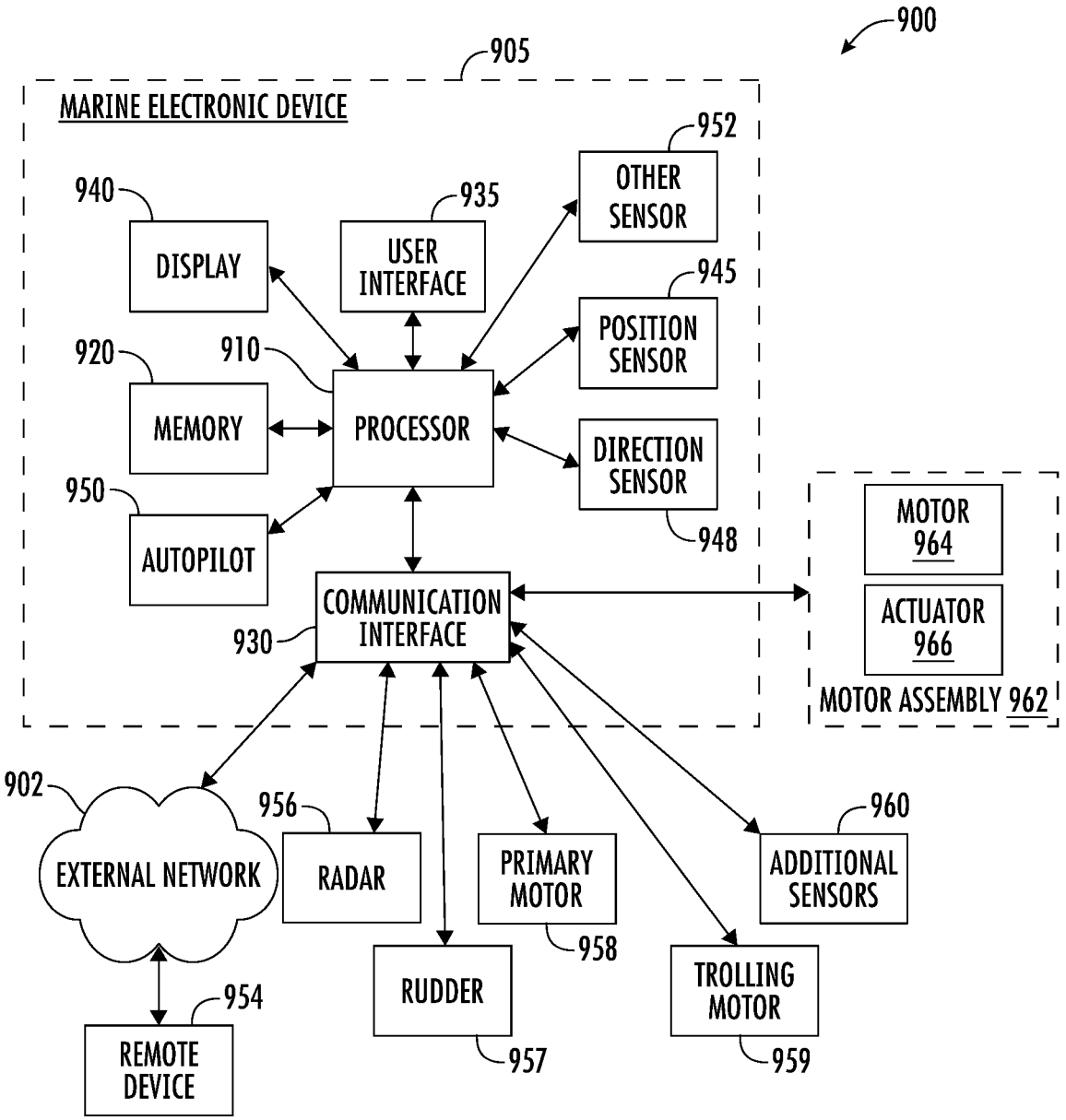
Figure 10:
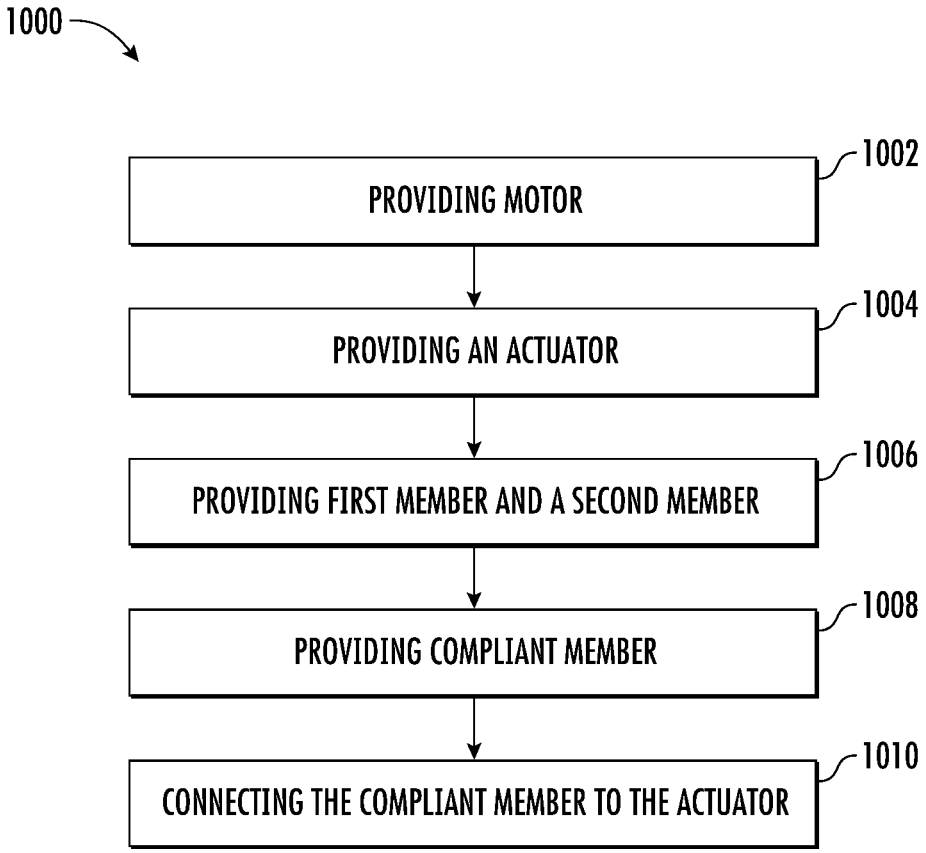

Having thus described the invention in general terms, reference will now be made to the accompanying drawings, which are not necessarily drawn to scale, and wherein:

FIG. 1 illustrates an example watercraft including various marine devices, in accordance with some embodiments discussed herein;

FIG. 2A-2B are perspective views illustrating an example motor assembly where the motor assembly is in a first position, in accordance with some embodiments discussed herein;

FIG. 2C is a perspective view illustrating the example motor assembly of FIGS. 2A-2B where the motor assembly has moved to a second position, in accordance with some embodiments discussed herein;

FIG. 3A is a schematic view illustrating a first recess of an example motor assembly, in accordance with some embodiments discussed herein;

FIG. 3B is a schematic view illustrating the first recess of the example motor assembly of FIG. 3A with a first member received in the first recess, in accordance with some embodiments discussed herein;

FIG. 4A is an enhanced, perspective view illustrating a second recess of an example motor assembly with a second member received in the second recess, in accordance with some embodiments discussed herein;

FIG. 4B is a schematic view illustrating a second recess of an example motor assembly with a second member received in the second recess, in accordance with some embodiments discussed herein;

FIG. 5 is a schematic view illustrating a compliant member in the form of a grommet, in accordance with some embodiments discussed herein;

FIG. 6 is a schematic view illustrating a compliant member in the form of a spring assembly, in accordance with some embodiments discussed herein;

FIG. 7 is a schematic, cross-sectional view illustrating a compliant member in the form of a spring assembly, in accordance with some embodiments discussed herein;

FIG. 8A is a schematic, cross-sectional view illustrating a compliant member in the form of a spring assembly, in accordance with some embodiments discussed herein;

FIG. 8B is a schematic view illustrating the spring assembly of FIG. 8A, in accordance with some embodiments discussed herein;

FIG. 9 is a block diagram illustrating various components on an example watercraft, in accordance with some embodiments discussed herein; and FIG. 10 is a flowchart illustrating an example method for assembly of a compliant member, in accordance with some embodiments discussed herein.

DETAILED DESCRIPTION

Example embodiments of the present invention now will be described more fully hereinafter with reference to the accompanying drawings, in which some, but not all embodiments of the invention are shown. Indeed, the invention may be embodied in many different forms and should not be construed as limited to the example embodiments set forth herein; rather, these embodiments are provided so that this disclosure will satisfy applicable legal requirements. Additionally, any connections or attachments may be direct or indirect connections or attachments unless specifically noted otherwise.

FIG. 1 is a schematic view illustrating an example watercraft including various marine devices. As illustrated in FIG. 1, the watercraft 100 (e.g., a vessel) is configured to traverse a marine environment, e.g. body of water 101, and may use one or more sonar transducer assemblies 102*a*, 102*b*, and 102*c* disposed on and/or proximate to the watercraft. Notably, example watercraft contemplated herein may be surface watercraft, submersible watercraft, or any other implementation known to those skilled in the art. The sonar transducer assemblies 102*a*, 102*b*, and 102*c* may each include one or more transducer elements configured to transmit sound waves into a body of water, receive sonar returns from the body of water, and convert the sonar returns into sonar return data. Various types of sonar transducers may be utilized for example, a linear downscan sonar transducer, a conical downscan sonar transducer, a sidescan sonar transducer, and/or one or more arrays of a plurality of sonar transducer elements.

Depending on the configuration, the watercraft 100 may include a primary motor 105, which may be a main propulsion motor such as an outboard or inboard motor. Additionally, the watercraft 100 may include a trolling motor 108 configured to propel the watercraft 100 or maintain a position. The one or more sonar transducer assemblies (e.g., 102*a*, 102*b*, and/or 102*c*) may be mounted in various positions and to various portions of the watercraft 100 and/or equipment associated with the watercraft 100. For example, the sonar transducer assembly may be mounted to the transom 106 of the watercraft 100, such as depicted by sonar transducer assembly 102*a*. The sonar transducer assembly may be mounted to the bottom or side of the hull 104 of the watercraft 100, such as depicted by sonar transducer assembly 102*b*. The sonar transducer assembly may be mounted to the trolling motor 108, such as depicted by sonar transducer assembly 102*c*. Other mounting configurations are contemplated also, such as may enable rotation of the sonar transducer assembly (e.g., mechanical and/or manual rotation, such as on a rod or other mounting connection).

The watercraft 100 may also include one or more marine electronic devices 160, such as may be utilized by a user to interact with, view, or otherwise control various functionality regarding the watercraft, including, for example, nautical charts and various sonar systems described herein. In the illustrated embodiment, the marine electronic device 160 is positioned proximate to the helm (e.g., steering wheel) of the watercraft 100 although other places on the watercraft 100 are contemplated. Likewise, additionally or alternatively, a remote device (such as a user's mobile device) may include functionality of a marine electronic device.

The watercraft 100 may also comprise other components within the marine electronic device 160 or at the helm. In FIG. 1, the watercraft 100 comprises a radar 116, which is mounted at an elevated position (although other positions relative to the watercraft are also contemplated). The watercraft 100 also comprises an AIS transceiver 118, a direction sensor 120, and a camera 122, and these components are each positioned at or near the helm (although other positions relative to the watercraft are also contemplated). Additionally, the watercraft 100 comprises a rudder 110 at the stern of the watercraft 100, and the rudder 110 is positioned on the watercraft 100 so that the rudder 110 will rest in the body of water 101. In other embodiments, some of these components may be integrated into the marine electronic device 160 or other devices. Another example device on the watercraft 100 includes a temperature sensor 112 that may be positioned so that it will rest within or outside of the body of water 101. Other example devices include a wind sensor, one or more speakers, and various vessel devices/features (e.g., doors, bilge pump, fuel tank, etc.), among other things. Additionally, one or more sensors may be associated with marine devices; for example, a sensor may be provided to detect the position of the primary motor 105, the trolling motor 108, or the rudder 110.

Various embodiments of the present invention are directed to providing shock absorption for movable assemblies, which may include motor assemblies (e.g., a trolling motor that moves between a stowed position and a deployed position, a main propulsion motor that moves between a stowed position and a deployed position, etc.) and other movable assemblies (e.g., a sonar system mounted to the watercraft that moves between a stowed position and a deployed position). In this regard, although much of the following disclosure is discussed with respect to the example of a trolling motor assembly, it will be evident to one of ordinary skill in the art in view of this disclosure that various embodiments of the present invention contemplate use with other movable assemblies, such as noted above.

As illustrated in FIGS. 2A through 2C, a motor assembly 200 may be moved between a first position (e.g., a deployed position) and a second position (e.g., a stowed position). FIGS. 2A-2B are different perspective views illustrating an example motor assembly 200 where the motor assembly is in a first position. FIG. 2C is a perspective view illustrating the example motor assembly 200 of FIGS. 2A-2B where the motor assembly has moved to a second position.

The motor assembly 200 may comprise a mount 202. The mount 202 may be attachable to a watercraft 100 (see FIG. 1) at various locations. For example, the mount 202 may be attached to the watercraft 100 at the transom 106 (see FIG. 1) of the watercraft 100, at the side of a hull 104 (see FIG. 1) of the watercraft 100, or at the front of the watercraft 100.

The motor assembly 200 also includes a support structure 204. The support structure 204 is pivotably mounted to the mount 202. The support structure 204 possesses a hub 206 that protrudes from the side of the support structure 204, and the mount 202 may define a hub cavity 208 that is slightly larger in cross-sectional size relative to the hub 206. The hub 206 may be received in the hub cavity 208 to permit pivotable movement of the support structure 204 relative to the mount 202.

In the illustrated embodiment, the support structure 204 also defines a hole 205. The support structure 204 may be configured to receive a motor (or a shaft connected to a motor) through hole 205 of the support structure 204. The motor may be a primary motor, a trolling motor, or some other kind of motor.

The motor assembly 200 may also include the actuator 218. The actuator 218 is configured to be activated to cause the motor assembly 200 to move between a first position and a second position, and this also causes the motor within the motor assembly 200 to move between a first position and a second position. In the illustrated embodiment, the actuator 218 is directly connected to a first end of a connection rod 222, with the connection rod 222 being threaded. The second end of the connection rod 222 is directly connected to a compliant member 220. In the illustrated embodiment, the compliant member 220 defines an internal recess where the connection rod 222 may be received, and internal threading is defined in the internal recess. The compliant member 220 is connected to the arm 224, and this arm 224 may be directly connected to the support structure 204. The compliant member 220 may comprise an elastic material such that the compliant member 220 may elastically deform as the motor assembly 200 experiences shock loading. In this way, the amount of shock loading at the actuator 218 is reduced. In the illustrated embodiment of FIGS. 2A-2C, the compliant member 220 is provided in the connectors between the actuator 218 and the support structure 204 so that the transfer of shock loading from the support structure 204 to the actuator 218 is reduced.

In the illustrated embodiment of FIGS. 2A-2C, the actuator 218 generates rotation of the connection rod 222 in a clockwise or a counterclockwise direction. Due to the threading provided on the connection rod 222 and the compliant member 220, rotation of the connection rod 222 may alter the distance between the actuator 218 and the compliant member 220. Where this distance is increased, the motor assembly 200 may be moved towards the first position illustrated in FIG. 2A. Where the distance between the actuator 218 and the compliant member 220 is decreased, the motor assembly 200 may be moved towards the second position illustrated in FIG. 2C. The actuator 218 may be configured to rotate the connection rod 222 such that the support structure is rotated at a relatively constant angular velocity in some embodiments, but the actuator 218 may be configured to rotate the connection rod 222 at a different angular velocity in some embodiments.

The support structure and mount may be configured to enable shock loading or transfer of shock through one or more connections or other interfaces. In this regard, shock may be absorbed or transferred when the assembly is in the first position (e.g., a deployed position), and, likewise, shock may be absorbed or transferred when the assembly is in the second position (e.g., a stowed position). In the illustrated embodiment, the support structure 204 also includes a first member 210 and a second member 214, and the mount 202 defines a first recess 212 and a second recess 216. As illustrated in FIG. 2A, the first recess 212 may be configured to receive the first member 210 when the motor assembly 200 is moved to a first position. When the motor assembly 200 is in the first position, the first member 210 is received in the first recess 212 and the first member 210 comes into contact with the sidewalls that form the first recess 212, and this contact dampens shock loading at the actuator 218 and/or transfers shock loading to another shock absorber so that shock loading at the actuator 218 may be dampened. Furthermore, as illustrated in FIG. 2C, the second recess 216 may be configured to receive the second member 214. When the motor assembly 200 is in the second position, the second member 214 contacts a sidewall that forms the second recess 216, and this contact dampens shock loading at the actuator 218 and/or transfers shock loading to another shock absorber so that shock loading at the actuator 218 may be dampened.

The compliant member 220 is particularly beneficial to dampen shock loading when the motor assembly 200 is at a location between the first position and the second position. In some embodiments, the first member 210 may provide less dampening of shock loading or even no dampening of shock loading when the motor assembly 200 is not in the first position. Furthermore, in some embodiments, the second member 214 may provide less dampening of shock loading or even no dampening of shock loading when the motor assembly 200 is not in the second position. Thus, the compliant member 220 is beneficial in that it provides additional dampening when the motor assembly 200 is moving between these positions. In some embodiments, the compliant member 220 may also assist in dampening the shock loading even when the motor assembly 200 is located at the first position and/or the second position. The compliant member 220 is just one example of a compliant member that may be utilized, as various other compliant members may be utilized.

As discussed in reference to FIGS. 2A-2C, the first member 210 may be received in a first recess 212 of the mount 202 in a manner that reduces the shock loading on the various components of the motor assembly, such as the actuator 218, when the motor assembly 200 is in a first position. FIGS. 3A-3B are schematic views illustrating a first recess 212 of an example motor assembly. In FIG. 3A, the first recess 212 is shown in isolation, without the first member 210 being illustrated. One or more walls 226 may be provided around the perimeter of the first recess 212. Once the first member 210 is introduced as illustrated in FIG. 3B, the first member 210 may be received within the first recess 212 such that the first member 210 comes into contact with the wall(s) 226. The contact between the first member 210 and the wall(s) 226 may assist in dampening shock loading that may occur while the motor assembly is in the first position. In some embodiments, the contact between the first member 210 and the wall(s) 226 may reduce the shock loading directly. In other embodiments, the contact between the first member 210 and the wall(s) 226 may transfer the shock loading to another shock absorber provided within the motor assembly 200 (e.g. a component within the mount 202 or a shock absorber connected to the mount 202).

The operation of the second member 214 and the second recess 216 may be more easily seen in FIGS. 4A and 4B. FIG. 4A is an enhanced, perspective view illustrating a second recess 216 of an example motor assembly where a second member 214 is received in the second recess 216. Additionally, FIG. 4B is a schematic view illustrating a second recess 216 of an example motor assembly where a second member is received in the second recess. The hub 206 is provided as part of the support structure 204, and the hub cavity 208 is defined within the mount 202. The hub 206 is received in the hub cavity 208 such that the support structure 204 is pivotably mounted to the mount 202.

Additionally, the second recess 216 is provided within the mount 202, and the second member 214 is provided as part of the support structure 204. As the support structure 204 pivots about the hub 206, the second member 214 moves along a curved track formed by the second recess 216. In the second position, the second member 214 may be forced against the wall 228 provided at the end of the track formed by the second recess 216. The force that urges the second member 214 against the wall 228 may be caused by a gravitational force acting on the support structure 204 and the motor attached to the support structure 204, and the gravitational force may generally retain the second member 214 in its position against the wall 228.

The contact between the second member 214 and the wall 228 may assist in dampening shock loading that may occur while the motor assembly is in the second position. In some embodiments, the contact between the second member 214 and the wall 228 may reduce the shock loading directly. In other embodiments, the contact between the second member 214 and the wall 228 may transfer the shock loading to another shock absorber provided within the motor assembly 200 (e.g. a component within the mount 202 or a shock absorber connected to the mount). In some embodiments, other walls that form the second recess 216 may assist in reducing shock loading or transferring at least some shock loading to another shock absorber provided within the motor assembly 200.

A compliant member may be provided in the form of a grommet 240 in some embodiments, and FIG. 5 is a schematic view illustrating an example of this. As illustrated, the mount 202 includes an extended portion 202A, and a recess 237 is defined in the extended portion 202A. However, in other embodiments, the recess 237 may be defined at other locations in the mount 202. A grommet 240 is positioned within the recess 237, and a rod 240A is positioned within an internal cavity of the grommet 240. In this way, the grommet 240 may dampen shock loading acting on the motor assembly so that the shock loading does not act on the actuator 218 (see FIG. 2B). The grommet 240 may comprise an elastic material such as rubber. Grommets may be provided at various locations in a motor assembly. In the illustrated embodiment of FIG. 5, the grommet 240 is provided in the connectors between the actuator 218 and the mount 202 so that the transfer of shock loading from the mount 202 to the actuator 218 is reduced.

A compliant member may be provided in the form of a spring assembly proximate to the mount 202 in some embodiments, and FIG. 6 is a schematic view an example of such a compliant member. The spring assembly 236 is attached to a connection rod 222, and the spring assembly 236 includes a spring 236A. The spring assembly 236 may be configured to pivot about recess 237 (see FIG. 5) so that the connection rod 222 may rotate. In some embodiments, the connection rod 222 may extend to an actuator 218 (see FIG. 2B). In other embodiments, the actuator 218 may be provided in place of the connection rod 222, and the actuator 218 may be directly connected to the spring assembly 236. The spring assembly 236 may be provided in connectors between the actuator 218 and the mount 202. In the illustrated embodiment of FIG. 6, the spring assembly 236 is provided in the connectors between the actuator 218 and the mount 202 so that the transfer of shock loading from the mount 202 to the actuator 218 is reduced.

The compliant member may be provided proximate to the actuator in some embodiments, and FIG. 7 illustrates an example of this. FIG. 7 is a schematic, cross-sectional view illustrating a compliant member in the form of a spring detent assembly 230. The actuator 218 is connected to a linkage 232. The linkage 232 may define a groove 232A having inclined walls on the side of the linkage 232. As illustrated in FIG. 7, the spring detent assembly 230 may include a spring 230A and a ball 230B. As shock loading is provided at the actuator 218, the shock loading and other forces may be transferred to the spring 230A of the spring detent assembly 230 so that the spring detent assembly 230 may dampen shock loading acting at the actuator 218. The spring 230A may be a linear spring in some embodiments. The spring 230A may be oriented in various directions, and the spring 230A is not required to be oriented in line with the actuator 218. For example, in FIG. 7, the spring 230A is oriented perpendicularly to a primary axis of the actuator 218. While the groove 232A is defined in the linkage 232 in the embodiment illustrated in FIG. 7, the linkage 232 may be omitted in other embodiments and the groove 232A may be defined at a side of the actuator 218.

Another modified spring assembly that may be used as a compliant member is illustrated in FIGS. 8A and 8B, with FIG. 8A providing a schematic, cross-sectional view and with FIG. 8B providing a basic schematic view. A modified rod 222' is illustrated in FIG. 8A, with a first rod 222A' and a second rod 222B'. The spring assembly 238 is positioned between the first rod 222A' and the second rod 222B'. The first rod 222A' is connected to the spring assembly 238 at a first end 238A of the spring assembly 238, and the second rod 222B' is connected to the spring assembly 238 at a second end 238B of the spring assembly 238.

As illustrated in FIG. 8A, the spring assembly 238 includes a first spring 247A, a second spring 247B, and a follower 242 inside the spring assembly 238. The first spring 247A is connected to the first rod 222A' on one end and is connected to the follower 242 on the other end, The second spring 247B is connected to the second rod 222B' on one end and connected to the follower 242 on the other end. Furthermore, as illustrated in FIG. 8B, the spring assembly 238 includes a cover 244. This cover 244 possesses a first opening 244A on the left side in the illustrated embodiment so that the first rod 222A' and the first spring 247A may be connected together, and the cover 244 possesses a second opening 244B on the right side in the illustrated embodiment so that the second rod 222B' and the second spring 247B may be connected together. The spring assembly 238 dampens shock loading acting on the motor assembly so that the shock loading does not act on the actuator 218 (see FIG. 2B). In some embodiments, the modified rod 222' may be provided in the connectors between the actuator 218 and the support structure 204 so that the transfer of shock loading from the support structure 204 to the actuator 218 is reduced.

Various components may be provided in the systems described herein, and FIG. 9 is a block diagram illustrating an example system 900 of components usable in various embodiments described herein. The system 900 may comprise numerous marine devices. As shown in FIG. 9, a motor assembly 962, a radar 956, a rudder 957, a primary motor 958, a trolling motor 959, and additional sensors/devices 960 may be provided as marine devices, but other marine devices may also be provided. For example, sonar transducers or sonar transducer assemblies (including movable sonar transducer assemblies, such as referenced herein) may be provided as additional sensors/devices 960. One or more marine devices may be implemented on the marine electronic device 905 as well. For example, a position sensor 945, a direction sensor 948, an autopilot 950, and other sensors 952 may be provided within the marine electronic device 905. These marine devices can be integrated within the marine electronic device 905, integrated on a watercraft at another location and connected to the marine electronic device 905, and/or the marine devices may be implemented at a remote device 954 in some embodiments. The system 900 may include any number of different systems, modules, or components; each of which may comprise any device or means embodied in either hardware, software, or a combination of hardware and software configured to perform one or more corresponding functions described herein.

The marine electronic device 905 may include at least one processor 910, a memory 920, a communication interface 930, a user interface 935, a display 940, autopilot 950, and one or more sensors (e.g. position sensor 945, direction sensor 948, other sensors 952). One or more of the components of the marine electronic device 905 may be located within a housing or could be separated into multiple different housings (e.g., be remotely located).

The processor(s) 910 may be any means configured to execute various programmed operations or instructions stored in a memory device (e.g., memory 920) such as a device or circuitry operating in accordance with software or otherwise embodied in hardware or a combination of hardware and software (e.g. a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor(s) 910 as described herein. In this regard, the processor(s) 910 may be configured to analyze electrical signals communicated thereto to provide or receive radar data, sonar data, or other data from various devices. In some embodiments, the processor(s) may cause signals to be sent to control the operation of the actuator 966 or other components. In some embodiments, the processor(s) 910 may be further configured to implement signal processing.

In an example embodiment, the memory 920 may include one or more non-transitory storage or memory devices such as, for example, volatile and/or non-volatile memory that may be either fixed or removable. The memory 920 may be configured to store instructions, computer program code, radar data, sonar data, and additional data in a non-transitory computer readable medium for use, such as by the processor(s) 910 for enabling the marine electronic device 905 to carry out various functions in accordance with example embodiments of the present invention. For example, the memory 920 could be configured to buffer input data for processing by the processor(s) 910. Additionally or alternatively, the memory 920 could be configured to store instructions for execution by the processor(s) 910.

The communication interface 930 may be configured to enable communication to external systems (e.g. an external network 902). In this manner, the marine electronic device 905 may retrieve stored data from a remote device 954 via the external network 902 in addition to or as an alternative to the onboard memory 920. Additionally or alternatively, the marine electronic device 905 may transmit or receive data, such as radar signal data, radar return data, radar image data, path data or the like to or from a motor assembly 962. In some embodiments, the marine electronic device 905 may also be configured to communicate with other devices or systems (such as through the external network 902 or through other communication networks, such as described herein). For example, the marine electronic device 905 may communicate with a propulsion system of the watercraft 100 (e.g., for autopilot control); a remote device (e.g., a user's mobile device, a handheld remote, etc.); or another system.

The communications interface 930 of the marine electronic device 905 may also include one or more communications modules configured to communicate with one another in any of a number of different manners including, for example, via a network. In this regard, the communications interface 930 may include any of a number of different communication backbones or frameworks including, for example, Ethernet, the NMEA 2000 framework, GPS, cellular, Wi-Fi, or other suitable networks. The network may also support other data sources, including GPS, autopilot, engine data, compass, radar, etc. In this regard, numerous other peripheral devices (including other marine electronic devices or transducer assemblies) may be included in the system 900.

The position sensor 945 may be configured to determine the current position and/or location of the marine electronic device 905 (and/or the watercraft 100). For example, the position sensor 945 may comprise a GPS, bottom contour, inertial navigation system, such as machined electromagnetic sensor (MEMS), a ring laser gyroscope, or other location detection system. Alternatively or in addition to determining the location of the marine electronic device 905 or the watercraft 100, the position sensor 945 may also be configured to determine the position and/or orientation of an object outside of the watercraft 100.

The display 940 (e.g. one or more screens) may be configured to present images and may include or otherwise be in communication with a user interface 935 configured to receive input from a user. The display 940 may be, for example, a conventional LCD (liquid crystal display), a touch screen display, mobile device, or any other suitable display known in the art upon which images may be displayed.

In some embodiments, the display 940 may present one or more sets of data (or images generated from the one or more sets of data). Such data includes chart data, radar data, sonar data, weather data, location data, position data, orientation data, sonar data, or any other type of information relevant to the watercraft. Radar data may be received from radar 956 or from radar devices positioned at other locations, such as remote from the watercraft. Additional data may be received from marine devices such as a motor assembly 962, a primary motor 958 or an associated sensor, a trolling motor 959 or an associated sensor, an autopilot 950, a rudder 957 or an associated sensor, a position sensor 945, a direction sensor 948, other sensors 952, a remote device 954, onboard memory 920 (e.g., stored chart data, historical data, etc.), or other devices.

The user interface 935 may include, for example, a keyboard, keypad, function keys, mouse, scrolling device, input/output ports, touch screen, or any other mechanism by which a user may interface with the system.

Although the display 940 of FIG. 9 is shown as being directly connected to the processor(s) 910 and within the marine electronic device 905, the display 940 could alternatively be remote from the processor(s) 910 and/or marine electronic device 905. Likewise, in some embodiments, the position sensor 945 and/or user interface 935 could be remote from the marine electronic device 905.

The marine electronic device 905 may include one or more other sensors/devices 952, such as configured to measure or sense various other conditions. The other sensors/devices 952 may include, for example, an air temperature sensor, a water temperature sensor, a current sensor, a light sensor, a wind sensor, a speed sensor, or the like.

A motor assembly 962 is also provided in the system 900. The motor assembly 962 includes a motor 964 and an actuator 966. The motor 964 may be a trolling motor and/or another motor (e.g., a primary motor, etc.) in some embodiments. Where the motor 964 is a trolling motor, a separate trolling motor 959 may be omitted from the system 900. Additionally, where the motor 964 is a primary motor, a separate primary motor 958 may be omitted from the system 900. The communication interface 930 may be connected directly to the motor 964 and/or the actuator 966 in some embodiments. However, in other embodiments, the communication interface 930 may be indirectly connected to the motor 964 and/or the actuator via a processor or some other component within the motor assembly 962.

The components presented in FIG. 9 may be rearranged to alter the connections between components. For example, in some embodiments, a marine device outside of the marine electronic device 905, such as the radar 956, may be directly connected to the processor(s) 910 rather than being connected to the communication interface 930. Additionally, sensors and devices implemented within the marine electronic device 905 may be directly connected to the communications interface 930 in some embodiments rather than being directly connected to the processor(s) 910.

Methods for making trolling motor assemblies having improved shock absorption are also provided in some embodiments. FIG. 10 is a flowchart illustrating an example method 1000 for the assembly for a compliant member to a movable assembly including a motor (although various embodiments contemplate other types of movable assemblies, such as described herein). At operation 1002, a motor is provided. This motor may be a trolling motor.

At operation 1004, an actuator is provided. The actuator is configured to be activated to cause the motor to move between a first position to a second position.

At operation 1006, a first member and a second member are provided. When the trolling motor is in the first position, the first member is configured to dampen shock loading at the actuator or to transfer shock loading to a shock absorber to dampen shock loading at the actuator. When the trolling motor is in the second position, the second member is configured to dampen shock loading at the actuator or to transfer shock loading to a shock absorber to dampen shock loading at the actuator. The shock absorber that the second member transfers shock loading to (if any) may be different than the shock absorber that the first member transfers shock loading to (if any), but the same shock absorber may be used in some embodiments.

At operation 1008, a compliant member is provided. At operation 1010, a compliant member is connected to the actuator. This connection may be a direct or indirect connection. The compliant member is configured to dampen shock loading to protect the actuator from shock loading as the trolling motor moves between the first position and the second position.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

That which is claimed:

1. A trolling motor assembly having improved shock absorption, the trolling motor assembly comprising:

a trolling motor;

an actuator that is configured to be activated to cause the trolling motor to move between a first position and a second position;

a compliant member that is configured to connect to the actuator;

a first member, wherein, when the trolling motor is in a first position, the first member is configured to dampen shock loading at the actuator or to transfer shock loading to a first shock absorber to dampen shock loading at the actuator;

a second member, wherein, when the trolling motor is in a second position, the second member is configured to dampen shock loading at the actuator or to transfer shock loading to at least one of the first shock absorber or a second shock absorber to dampen shock loading at the actuator, a support structure, wherein activation of the actuator causes movement of the support structure so that the trolling motor moves between the first position and the second position, the support structure includes a hub, and the support structure includes the first member, a mount, wherein the mount defines a first recess, the mount includes a hub cavity that is configured to receive the hub, wherein the compliant member is configured to dampen shock loading to protect the actuator from shock loading as the trolling motor moves between the first position and the second position, the support structure is configured to rotate relative to the mount about the hub, the first member is configured to be received in the first recess when the trolling motor is in the first position, and contact between the first member and a wall forming the first recess dampens shock loading at the actuator or transfers shock loading to the first shock absorber.

2. The trolling motor assembly of claim 1, wherein the first member is configured so that the first member dampens shock loading at the actuator or transfers shock loading in increased amounts when the trolling motor is in the first position as compared to other instances when the trolling motor is in the second position or at an intermediary position between the first position and the second position, wherein the second member is configured so that the second member dampens shock loading at the actuator or transfers shock loading in increased amounts when the trolling motor is in the second position as compared to other instances when the trolling motor is in the first position or at an intermediate position between the first position and the second position.

3. The trolling motor assembly of claim 1, wherein the first member is configured so that, when the trolling motor is in the second position or moving between the first position and the second position, the first member neither dampens shock loading at the actuator nor transfers shock loading.

4. The trolling motor assembly of claim 3, wherein the second member is configured so that, when the trolling motor is in the first position or moving between the first position and the second position, the second member neither dampens shock loading at the actuator nor transfers shock loading.

5. The trolling motor assembly of claim 1, wherein the support structure includes the second member, wherein the mount defines a second recess, wherein the second member is configured to be received in the second recess when the trolling motor is in the second position, wherein contact between the second member and a wall forming the second recess dampens shock loading at the actuator or transfers shock loading to the first shock absorber or the second shock absorber.

6. The trolling motor assembly of claim 1, wherein the trolling motor assembly is configured such that the trolling motor is positioned out of the water when in the first position, and wherein the trolling motor assembly is configured such that the trolling motor is positioned in the water when in the second position.

7. The trolling motor assembly of claim 1, wherein the compliant member is configured to be compressed or expanded under loads without any deformation in the compliant member when the loads are removed.

8. The trolling motor assembly of claim 1, wherein the compliant member is a grommet.

9. The trolling motor assembly of claim 8, wherein the compliant member includes elastomeric material.

10. The trolling motor assembly of claim 1, wherein the compliant member includes a spring assembly.

11. The trolling motor assembly of claim 10, wherein the spring assembly includes a rotational spring or a linear spring.

12. The trolling motor assembly of claim 1, wherein the complaint member comprises at least one of hard rubber or steel.

13. The trolling motor assembly of claim 1, wherein the complaint member includes at least one of an elastomer, a gas shock, a gas damper, a hydraulic shock, or a hydraulic damper.

14. The trolling motor assembly of claim 1, wherein the complaint member provides additional strength to the trolling motor assembly in rough water.

15. The trolling motor assembly of claim 1, wherein the compliant member reduces a likelihood of failure of components in the actuator.

16. A motor assembly having improved shock absorption, the motor assembly comprising:

a motor;

an actuator that is configured to be activated to cause the motor to move between a first position to a second position;

a compliant member that is configured to connect to the actuator;

a first member, wherein, when the motor is in a first position, the first member is configured to dampen shock loading at the actuator or to transfer shock loading to a first shock absorber to dampen shock loading at the actuator;

a second member, wherein, when the motor is in a second position, the second member is configured to dampen shock loading at the actuator or to transfer shock loading to at least one of the first shock absorber or a second shock absorber to dampen shock loading at the actuator, wherein the compliant member is configured to dampen shock loading to protect the actuator from shock loading as the motor moves between the first position and the second position, wherein the first member is configured so that, when the motor is in the second position or moving between the first position and the second position, the first member neither dampens shock loading at the actuator nor transfers shock loading.

17. A method of making a trolling motor assembly having improved shock absorption, the method comprising:

providing a trolling motor;

providing an actuator;

providing a first member and a second member;

providing a compliant member; and connecting the compliant member to the actuator, wherein the actuator is configured to be activated to cause the trolling motor to move between a first position to a second position, wherein the trolling motor is positioned out of water when in the first position, wherein, when the trolling motor is in the first position, the first member is configured to dampen shock loading at the actuator or to transfer shock loading to a first shock absorber to dampen shock loading at the actuator, wherein the trolling motor is positioned in the water when in the second position, wherein, when the trolling motor is in the second position, the second member is configured to dampen shock loading at the actuator or to transfer shock loading to at least one of the first shock absorber or a second shock absorber to dampen shock loading at the actuator, and wherein the compliant member is configured to dampen shock loading to protect the actuator from shock loading as the trolling motor moves between the first position and the second position, wherein the first member is configured so that the first member dampens shock loading at the actuator or transfers shock loading in increased amounts when the trolling motor is in the first position as compared to other instances when the trolling motor is in the second position or at an intermediary position between the first position and the second position, wherein the second member is configured so that the second member dampens shock loading at the actuator or transfers shock loading in increased amounts when the trolling motor is in the second position as compared to other instances when the trolling motor is in the first position or at an intermediate position between the first position and the second position.

* * * * *